United States Patent [19]

Holt et al.

[11] Patent Number: 4,800,814

[45] Date of Patent: Jan. 31, 1989

[54] ARMING DEVICES

[75] Inventors: Alan W. Holt; Martin Thaw, both of Herts, United Kingdom

[73] Assignee: British Aerospace Public Limited Company, London, England

[21] Appl. No.: 882,917

[22] Filed: Apr. 7, 1986

[51] Int. Cl.[4] ..... F42B 13/50; F42C 15/04

[52] U.S. Cl. ..... 102/226; 102/240; 102/254; 102/263

[58] Field of Search ..... 102/226, 225, 229, 254, 102/263, 348, 388, 227, 240, 256

[56] References Cited

U.S. PATENT DOCUMENTS

| | | | |
|---|---|---|---|
| 1,191,742 | 7/1916 | Semple | 102/227 |
| 2,850,978 | 9/1958 | Franklin | 102/256 X |
| 3,076,410 | 2/1963 | Guerne | 102/240 |
| 3,516,359 | 6/1970 | Weber et al. | 102/240 |
| 3,792,662 | 2/1974 | Wolferman | 102/226 |
| 3,913,483 | 10/1975 | Wolferman | 102/226 |
| 3,998,164 | 12/1976 | Hadfield | 102/226 |
| 4,467,723 | 8/1984 | Kaiser et al. | 102/240 |
| 4,622,898 | 11/1986 | Dahl | 102/240 X |

FOREIGN PATENT DOCUMENTS

| | | | |
|---|---|---|---|
| 0105001 | 4/1984 | European Pat. Off. . | |
| 865053 | 5/1941 | France | 102/227 |
| 496081 | 11/1938 | United Kingdom . | |
| 1413919 | 11/1975 | United Kingdom . | |
| 1558740 | 1/1980 | United Kingdom . | |
| 1603227 | 11/1981 | United Kingdom . | |

*Primary Examiner*—David H. Brown

*Attorney, Agent, or Firm*—Cushman, Darby & Cushman

[57] ABSTRACT

An arming device for a missile having a rotating tail fin assembly is disclosed. The device includes a distance counter comprising a given length of coiled tape contained within a rotatable drum, the length of the tape being determined by the distance required to be covered by the missile before arming the warhead. The tape is wound onto a shaft driven by the tail fin assembly from the drum which is initially locked to the missile body, and when the tape has been completely wound onto the shaft, the drum is released and is free to rotate through a half-turn to initiate arming of the warhead.

10 Claims, 5 Drawing Sheets

ARMING DEVICES

This invention relates to arming devices for projectile warheads and is more particularly but not exclusively concerned with spin stabilised projectiles of the kind in which tail fin assemblies are free to rotate with respect to the projectile body.

It is usually desirable that a projectile warhead only becomes armed once the projectile has been launched and has covered a minimum 'safe' distance from its launch-point.

According to a first aspect of the present invention, there is provided a warhead arming device for a missile having a rotatable tail fin assembly, the arming device comprising arming means, rotatable drum means operable for rotation from a first to a second position relative to said arming means, locking means for locking said drum means in said first position, control means connected to said tail fin assembly and operable to release said locking means after said tail fin assembly has completed a predetermined number of revolutions, thereby allowing said drum means to rotate to said second position to arm said warhead.

Preferably, said control means comprises shaft means attached to said tail fin asssembly and a flexible elongate element contained within said drum means, one end of said element being attached to said shaft means and the other end being attached to said locking means, the element being wound round said shaft means during said revolutions.

According to a second aspect to the invention, there is provided a control device for use in a weapon for initiating an output response, for example arming the weapon, the control device comprising first and second members mounted for relative rotation, and a flexible elongate element coupled between said first and second members for becoming wound onto said first member when said relative rotation occurs and, when the element has become so wound through at least a plurality of turns, for pulling the second member to move it and thereby initiate said response.

For a better understanding of the invention, reference will now be made, by way of example, to the accompanying drawings in which.

Figure 1:
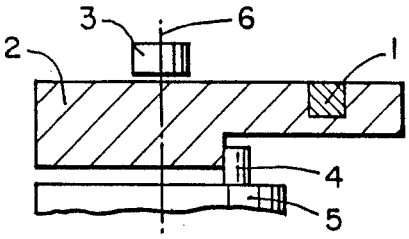
FIG. 1 is a partly sectioned side elevation of an arming device for arming a missile warhead, having a shutter forming part of the device, the shutter being shown in its 'safe' position.
Figure 2:
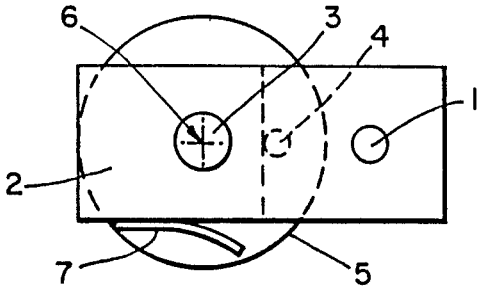
FIG. 2 is a plan view of the FIG. 1 devices in its 'safe' position.
Figure 5:
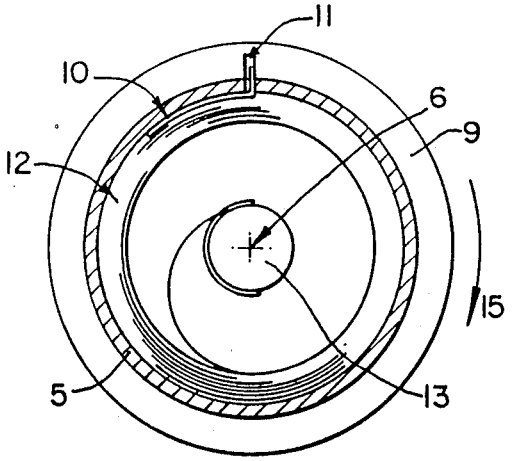
FIG. 5 is a sectional view of a drum arrangement which may be used in the FIG. 1 device, the drum being in a locked position.
Figure 6:
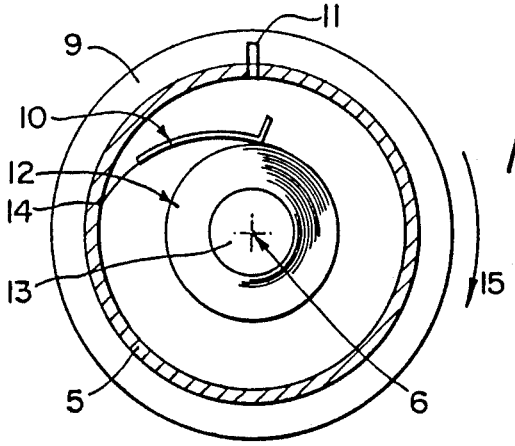
Figure 7:
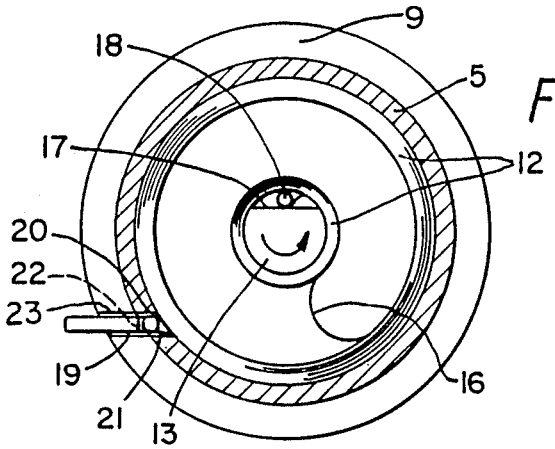
Figure 8:
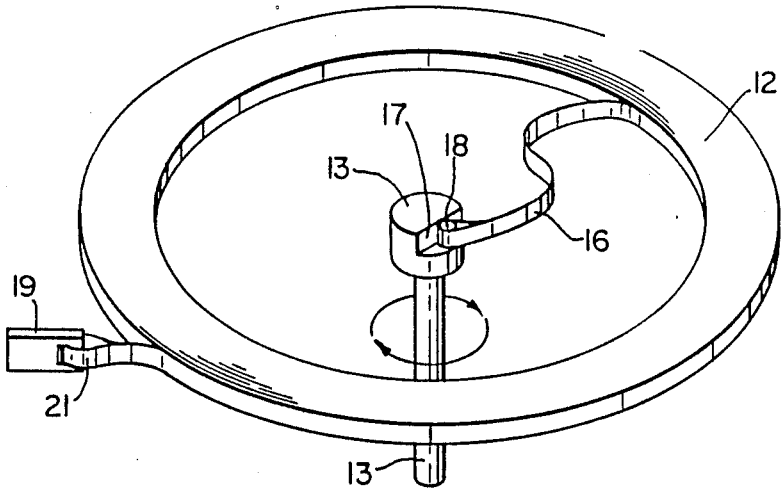
Figure 9:
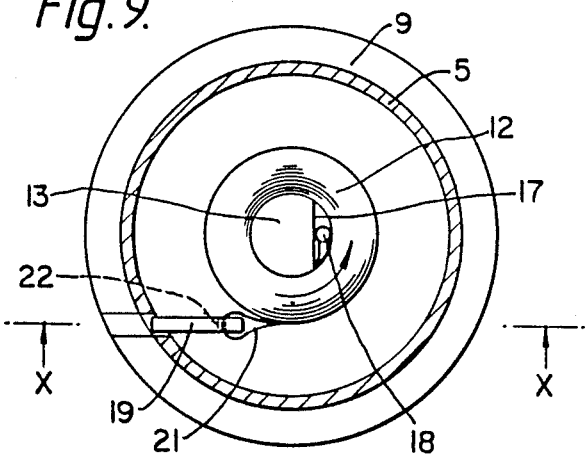
Figure 10:
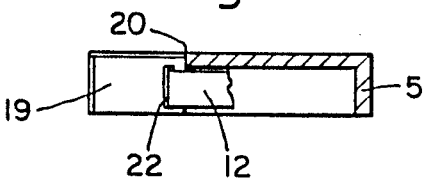

FIG. 6 corresponds to FIG. 5 but showing the drum arrangement in a release position;

FIG. 7 is a sectional view of another drum arrangement which may be used in the FIG. 1 device in its locked position;

FIG. 8 is a perspective view of the FIG. 7 arrangement with the drum and housing removed;

FIG. 9 corresponds to FIG. 7 but shows the drum arrangement in its released position;

FIG. 10 is a section on X—X in FIG. 9; and

Figure 11:
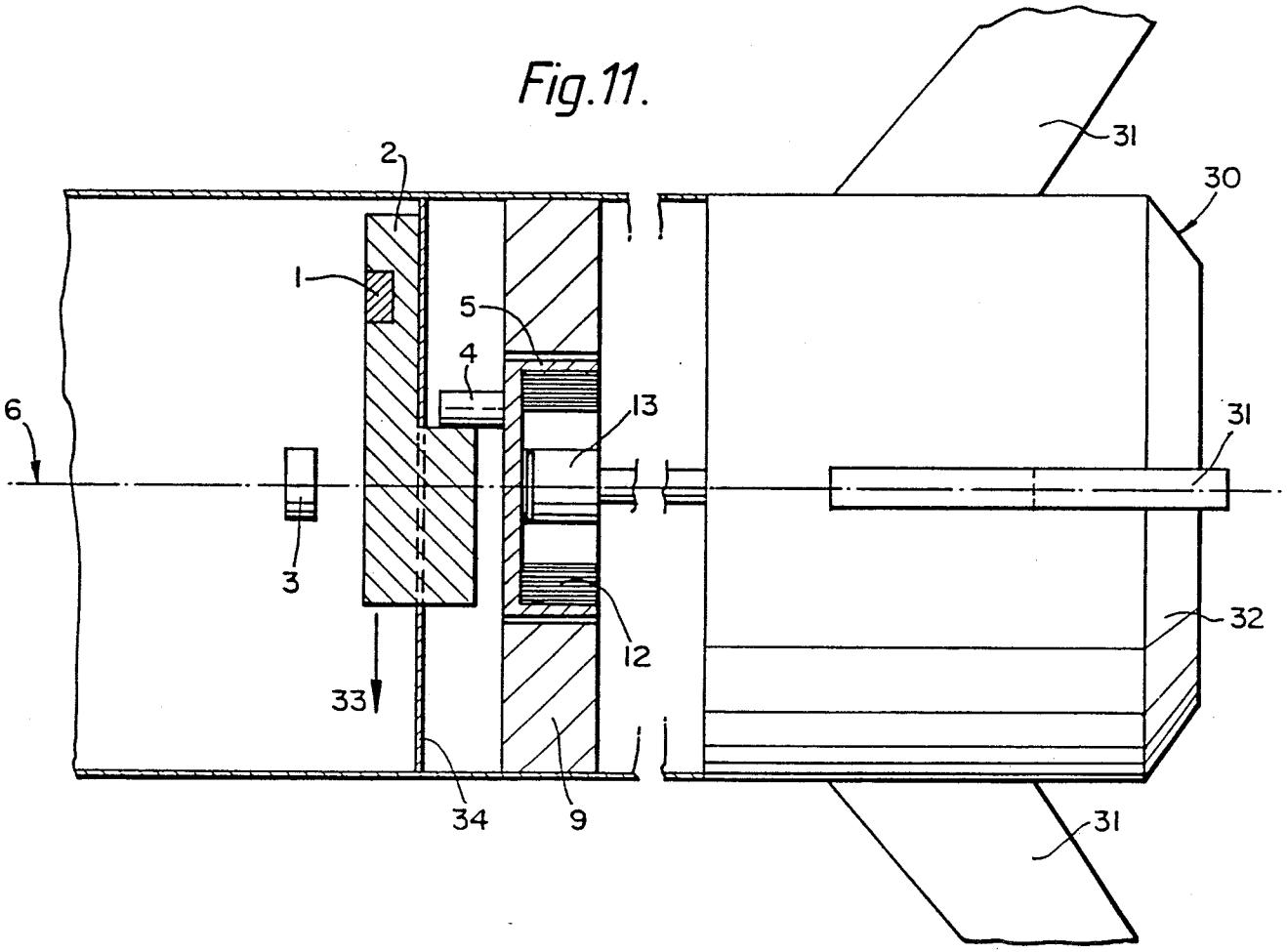

FIG. 11 shows a part sectioned portion of the tail end of a missile having the arming device of the previous figures mounted on board.

Figure 3:
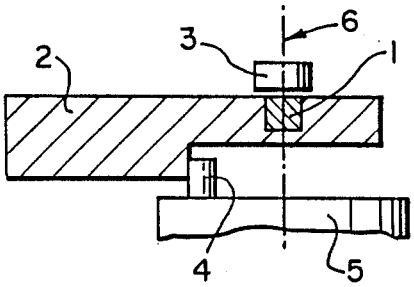
FIG. 3 is a partly sectioned side elevation of the FIG. 1 device shown in its 'armed' position.
Figure 4:
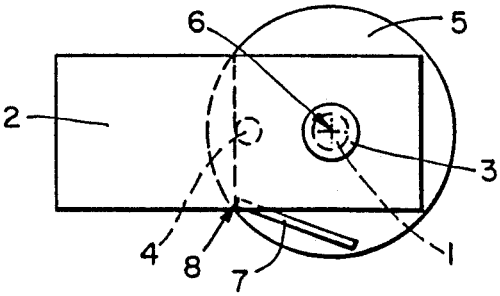
FIG. 4 is a plan view of the FIG. 1 device in its 'armed' position.

FIGS. 1 to 4 show part of an arming device which is mounted on board a missile as shown in FIG. 11. An electrically-activated detonator 1 is mounted in a slidable shutter 2, which slides in grooves or guideways (not shown) from a 'safe' position (FIGS. 1 and 2) to an 'armed' position (FIGS. 3 and 4). In the 'safe' position, a first pair of contact switches (not shown) complied between the missile fuse (not shown) and the detonator 1 are 'open' while a second pair of contact switches (not shown) are closed so as to short-out the detonator by one pair of contact switches (not shown). Thus no electrical energy can be present in the circuit to fire the detonator 1 prematurely. Also, since the detonator is spaced from a stemming charge 3 leading to the actual missile warhead, the warhead is not set off even if the detonator 1 were to be prematurely fired. In the 'armed' position, first contacts are opened while a second such pair of contact switches (not shown) are closed to complete a circuit leading from an electrical energy supply to the detonator 1 via the fuse. Meanwhile, the shutter 2 is driven from the 'safe' to an 'armed' position by a drive pin 4 which is attached to a rotatable drum 5. The drum is rotatable about axis 6, the missile axis, and is initially locked in the 'safe' position. When released, the drum 5 is able to rotate, sliding the shutter 2 in its guideways to align the detonator 1 with the stemming charge 3 (mounted on the missile axis), the drum 5 rotating half a turn to move the shutter 2 from its 'safe' to its 'armed' position. Then, when the detonator 1 is fired, the firing sequence for the missile warhead (not shown) is initiated by the stemming charge 3. A spring latch 7 engages with the shutter 2 at a point 8 on its underside (FIG. 4) to prevent the shutter sliding out of the 'armed' position.

FIGS. 5 and 6 illustrate one embodiment of the arrangement within the drum 5 ie the means for rotating the drum. The drum 5 is mounted for rotation with respect to a housing 9, but is locked to the housing when in the 'safe' position, by means of a latch 10 which engages with a hole 11 formed in the wall of the drum 5 and the housing 9. The latch 10 is attached to a steel tape or ribbon 12 near one end 14 thereof which end is fixed to the wall of drum 5 and which is coiled within the drum 5 in the direction of rotation. Because of the elasticity of the steel ribbon 12, the coiled ribbon expands radially outwards and is constrained by the wall of the drum 5 as shown in FIG. 5. The other end of the ribbon 12 is attached to a central drive shaft 13 which is connected to the tail fin assembly of the missile (not shown). As the tail fin assembly rotates during flight of the missile, the shaft 13 rotates about axis 6 in the direction of arrow 15 thereby unwinding ribbon 12 from the wall of drum 5 and instead winding it onto the shaft 13 as shown in FIG. 6. When all the ribbon 12 is wound onto the shaft 13, the latch 10 becomes disengaged from the hole 11 and then further rotation of shaft 13 pulls the drum 5 with it, thereby sliding the shutter 2 into its 'armed' position as previously described.

Depending on its detailed design, with the embodiment of FIGS. 5 and 6, there might be a tendency for the coiled ribbon 12 to fall away from the wall of the drum.

If so a second drum embodiment shown in FIGS. 7 to 10 may be preferred. Here, the ribbon 12 is coiled in the direction opposite to the direction of rotation of the shaft 13. Thus, between the drum 5 and shaft 13, the ribbon forms a rolling half loop 16 which tends to maintain the ribbon in place against the wall of the drum. The shaft 13 has a shoulder 17 formed on it which provides a mounting place for a pivot pin 18. The shaft end of the ribbon 12 is looped around the pin 18 and is able to turn with respect to it hence reducing any tendency for the ribon to break as it is wound onto the shaft 13. Also, a different drum latching arrangement is used in this embodiment. Here, a loop 21 formed at the drum end of ribbon 12 is pivotably engaged through an aperture 22 in a rectangular latch member 19.

Initially, this latch member is engaged in a slot 20 in the wall of drum 5 so as to extend into a corresponding slot 23 in the wall of the housing 9 when the ribbon has been fully wound onto the shaft 13, the latch member is pulled out of the slot 23 in the housing wall so releasing the drum for rotation relative to the housing and then the latch member catches in the slot 20 in the drum wall so that further rotation of the shaft pulls the drum with it.

The relative positions of the drum 5, shutter 2 and tail fin assembly on the missile are shown in FIG. 11. Items previously described are referenced similarly. The tail fin assembly 30 comprises four fins 31 (only three of which are shown) attached to a rotating hub 32, the hub 32 being connected to the shaft 13 to provide the drive for winding the tape or ribbon 12. As mentioned previously, the shutter 2 slides laterally ie in the direction of arrow 33, in guideways or grooves 34 to align the detonator 1 with the stemming charge 3, when the drum 5 rotates through 180°.

Instead of a rotating tail fin assembly, the missile could comprise some other member which rotates relative to the missile body as it is launched. For example, a wheel which extends from the body so as to be rotated by its engagement with the missile launching barrel. Such other member, could be used to rotate shaft 13 relative to the drum 5.

In both embodiments described, the length of the ribbon 12 determines how many revolutions of the tail fin assembly have to be executed before the warhead is armed.

Naturally, this invention is not limited to use on board missiles but may be used in any system which has a rotating member onto which the ribbon 12 may be wound in order to measure a given distance or time, both distance and time being related to the number of revolutions of the rotating member.

Instead of sliding the shutter 2 to align the detonator 1 with the stemming charge 3 when the drum 5 rotates, the rotation of the drum 5 itself can be used to make electrical switch contacts between the drum and the housing 9. In such a case, the making of the switch contacts may initiate arming, detonation or some other desired function, for example igniting a boost motor for the missile.

We claim:

1. A projectile comprising:

a projectile body;

a control device mounted in said body and including a part which is fixed relative to said body and a movable element which is movable relative to the fixed part to initiate a projectile control action by the device;

a first movable member mounted within said body for turning movement relative to the body about an axis, the first member having portions defining an internal surface which extends around said axis and which bounds a space within the first member and containing said axis, said first member also being coupled to said movable element of said control device;

disengageable latch means connected to the first member for initially preventing said turning movement of the first member;

a second movable member positioned in said space within the first member and mounted for rotation relative to the first member about said axis;

drive means coupled to said second member for producing rotation of the second member relative to the first member in response to movement of the projectile upon launch thereof; and, a flexible elongate strip which is initially wound up through a plurality of turns around and adjacent said internal surface defined by portions of the first member; of which an inner end portion is connected to said second member, of which an outer end portion is coupled to said latch means and said first member, and which is operative, during said relative rotation of the second member, to be progressively wound off said internal surface onto said second member and then to pull said latch means to disengage it and to pull said first member to turn the first member and move said movable element of the control device.

2. A projectile according to claim 1, wherein said drive means is operable to rotate the second member in a direction opposite to the direction of the wound up strip proceeding from the outer end of the strip towards its inner end, and the strip extends through a rolling half-loop into engagement with the second member.

3. A projectile according to claim 1, wherein the projectile has a tail fin assembly mounted for rotation relative to said body and said drive means comprising a drive shaft coupled between said tail fin assembly and said second member.

4. A projectile according to claim 1, wherein the projectile comprises a stem charge positioned in said missile body for igniting an explosive warhead of the projectile and wherein said control device is an arming unit comprising:

a shutter member; and, a detonator supported by the shutter member; said shutter member being laterally movable between a first position in which the detonator is spaced away from the stem charge and in which a portion of the shutter member extends over the stem charge to isolate it from the detonator; and a second position in which the detonator faces and is in alignment with the stem charge; said first movable member comprising a portion for engaging the shutter member and moving it from said first to said second position.

5. A projectile according to claim 4, including spring latch means engaged with the shutter member for latching the shutter in said second position.

6. A projectile according to claim 1, including a spigot member on which said strip is wound and a fixed structure mounted in said body adjacent said first member, there being respective apertures in said first member and said fixed structure and said latch means comprising a latch member which extends through the aperture in the first member and into the aperture in the fixed structure, said strip being operative when wound onto said spigot member to pull the latch member out of the aperture in the fixed structure.

7. A projectile according to claim 6, wherein the latch member is attached to the strip near the outer end of the strip and the outer end of the strip is attached to said internal surface of the first member.

8. A projectile according to claim 6, wherein the outer end of the strip is attached to the latch member and the latch member comprises a portion which becomes operative, after the latch member has been pulled out of the aperture in the fixed member, to become caught in the aperture in the first member.

9. A projectile comprising:

a projectile body;

a flight stabilizing fin assembly coupled to the projectile body for relative rotation of the body and the fin assembly to occur during flight of the projectile about an axis extending through the body in the direction of flight of the projectile;

an arming unit mounted in the body and including a movable element for being moved to arm an explosive warhead of the projectile;

a hollow drum mounted in the body for turning movement relative to the body about said axis and coupled to said movable element of the arming unit for said turning movement of the drum to produce movement of the movable element;

latch means connected to said drum for initially preventing said turning movement;

a drive shaft one end of which is connected to said fin assembly which extends along said axis and a winding portion at the other end of which lies within said drum; and a multiple turn coil of tape which is positioned in the drum with its outer turn up against the inner surface of the peripheral wall of the drum, of which an end portion at the outside of the coil is connected to the latch means and the drum, and of which the end inside the coil is connected to said winding portion of said drive shaft for the tape to become wound onto said winding portion by rotation of the drive shaft relative to the drum.

10. A mechanism for use on board a projectile for initiating a projectile control action after a safety delay time dependent upon movement of the projectile following its launch, the mechanism comprising:

a support member for being fixedly mounted in a body of the projectile;

a hollow drum supported by the support member for turning movement about the drum axis with respect to the support member;

a latch member engage between the drum and the support member for initially preventing said turning movement;

a winding member mounted within said drum for rotation relative to the drum about said drum axis;

drive means connected to the winding member for producing said relative rotation;

a multiple turn coil of tape lying inside the drum with its outer turn against the internal surface of the wall of the drum, the tape being connected to the drum, the latching means and the winding member for said relative rotation of the winding member to wind the tape off from the inside of the coil onto the winding member and then to pull the latching member to disengage it and to pull the drum to turn it.

* * * * *